United States Patent [19]

Meadows

[11] Patent Number: 4,930,282

[45] Date of Patent: Jun. 5, 1990

[54] ARCHITECTURAL TILE

[76] Inventor: David F. Meadows, Rte. 3, Box 51, Milton, W. Va. 22541

[21] Appl. No.: 148,608

[22] Filed: Jan. 26, 1988

[51] Int. Cl.[5] ..... E04D 1/34

[52] U.S. Cl. ..... 52/551; 52/570; 52/553; 52/793

[58] Field of Search ..... 52/570, 574, 579, 584, 52/588, 593, 793, 511, 550, 551, 522, 553

[56] References Cited

U.S. PATENT DOCUMENTS

| | | | |
|---|---|---|---|
| 478,171 | 7/1892 | Rapp | 52/553 X |
| 3,191,724 | 6/1965 | De Ridder | 52/793 X |
| 3,289,375 | 12/1966 | Cline | 52/570 X |
| 3,992,839 | 11/1976 | La Borde | 52/570 X |

*Primary Examiner*—David A. Scherbel
*Assistant Examiner*—Creighton Smith
*Attorney, Agent, or Firm*—Berman, Aisenberg & Platt

[57] ABSTRACT

An architectural tile is formed of a body portion having securing means extending therefrom. A plurality of tiles are secured together to form a roof or wall covering. The securing means include leg portions which are flexible and guide bars for directing securing means from facing tiles into interlocking positions. The legs are of sufficient length to provide flexibility and to prevent leakage of water into the gaps between adjacent lower tiles. Ridges extend from the lower surfaces of the body portions for spacing an overlapping tile from an overlapped tile to form a shadow line. The body portions may be flat or curved or a combination of flat and curved portions.

16 Claims, 3 Drawing Sheets

ARCHITECTURAL TILE

TECHNICAL FIELD

This invention relates to the art of building construction materials and, in particular, to tiles used for roofing or siding.

BACKGROUND ART

It is known to construct a roof of a plurality of overlapped tiles, such as clay tiles. This type of tile is quite expensive to apply because of its weight and the methods required for installation. The use of plastic tiles for roofing or for siding is known, plastic being generally less expensive because of its light weight and ease of installation.

It is also known to provide a panel with interlocking parts to secure adjacent panels together. One such interlocking panel is shown in U.S. Pat. No. 3,289,375 (Cline). This patent teaches a flat panel having a web extending from the bottom surface of a flange and terminating in a fork-like connecting part. The fork engages L-shaped hooks on edges of two facing panels to secure the three panels together. The structure shown by the Cline patent would be extremely difficult to assemble and would not be effective with plastic materials because of their high coefficients of thermal expansion. More importantly, Cline's structure does not permit the overlapping required for roofing tile.

Other interconnecting panels used in building construction are shown in U.S. Pat. No. 3,191,724 (Ridder) and U.S. Pat. Re. No. 626,006 (Heidt).

SUMMARY OF THE INVENTION

In accordance with the invention, a panel for a roof or the side of a building is provided by combining a plurality of interlocking tiles. Preferably, the tiles are made of molded or extruded plastic, but they made be of other constructions, as will be apparent to those of skill in the art.

Each tile includes securing means which extend from a bottom surface of the tile to engage securing means on a facing tile. Each of the securing means includes a leg and a guide bar at the end of the leg remote from the body of the tile. The guide bar is transverse to the leg and is oriented to assist in interlocking the parts together.

A securing means is located at opposite ends of the body and at least two securing means are located intermediate the ends. The securing means intermediate the ends form a clamp for receiving securing means from the facing panel. The legs of the securing means which form the clamps are attached at spaced locations of the panel and are flexible to move apart elastically and allow insertion of the securing means from the facing tiles. The interlocking of the securing means provides a tight locking of the panels together and yet is flexible enough to allow the overlapping feature of the invention.

The lengths of the legs of the securing means are such that adequate flexibility is provided and such that channels are formed to direct rain water away from the joints between the tiles to prevent leakage.

The bottom surfaces of the tiles have ridges for spacing an upper tile from a lower tile in a region of overlap. In this region of overlap, the securing means, which generally extend the length of the tile, terminate at locations spaced inwardly from one end of the tiles to permit that end to overlap the adjacent tile. The small vertical space between the overlapped tiles caused by the ridges creates a shadow line to create a visual effect similar to that of a clay tile. The spacing between the tiles created by the ridges also permits the creation of a "chimney" which causes air to flow around and between the plastic tiles. This flow of air prevents heat buildup and maintains the temperature of the tile below that at which distortion occurs.

The tiles are preferably curved to simulate the appearance of a clay tile and to provide flexibility. In one embodiment, the tile comprises a flat portion and a curved portion. The securing means which form the clamp extend from the curved portion to provide additional flexibility.

An object of this invention is to provide a tile which is easily manufactured of molded or extruded material and easily assembled.

Another object of this invention is to provide a construction tile which is easily assembled with a plurality of like tiles to form a ceiling or wall.

Still another object of this invention is to provide a construction tile having securing means extending from the body of the tile to provide flexibility and strength for assembling and securing tiles together.

DETAILED DESCRIPTION OF THE DRAWINGS

Figure 1:
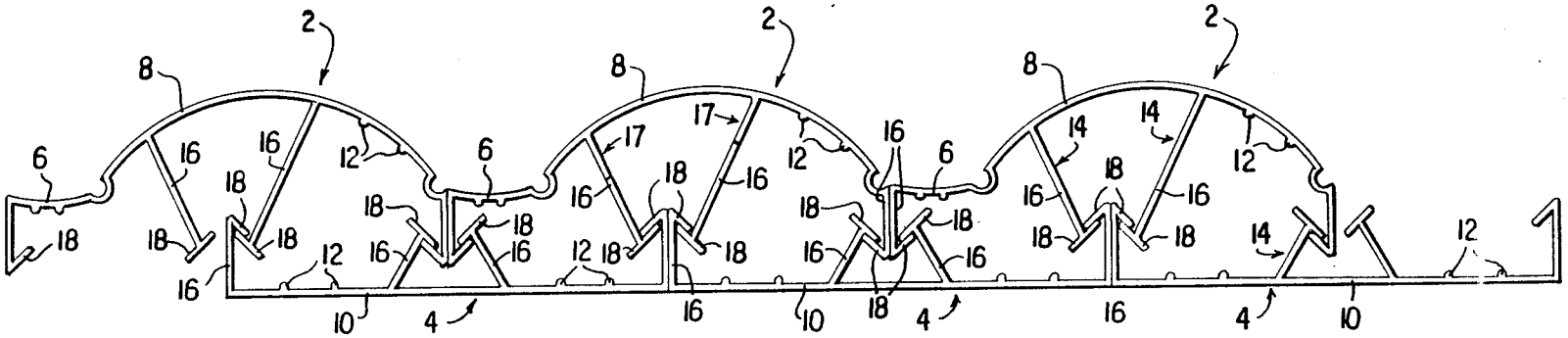
FIG. 1 is an end view of a preferred tile in accordance with the invention.

With reference to FIG. 1, a first plurality of tiles 2 is secured to a second plurality of tiles 4. Tiles 4 are attached to a structure, such as a wall or roof (neither shown), by nails, or other fasteners (not shown). Tiles 2 comprise a body portion having flat parts 6 and curved parts 8. Tiles 4 comprise a body part 10 which is flat. It will be appreciated from the description below that the body parts of the tiles may, however, have several forms.

The tiles are preferably arranged such that tiles 4 are below the tiles 2, tiles 2 covering the intersections between the tiles 4. As will be described in more detail with respect to FIG. 4, ends of tiles 2 overlap longitudinally adjacent tiles 2 to create the appearance of overlapped clay tiles. Ridges 12 extend from the bottom surfaces of the body portions to provide a space between the bottom surface of the upper tile and the upper surface of a lower tile to create a shadow line simulating the appearance of clay tile.

A plurality of securing means 14 extend from the bottom surfaces of the body portions of the tiles. Each securing means 14 includes a leg part 16 and a guide bar 18. The leg parts are preferably flexible to permit corresponding securing means from a facing tile to be inserted easily and tightly engaged. The leg parts attach directly to the bottom surface of the body, thus providing a long leg which can be made to be quite flexible. The geometry of the leg parts 16 extending from the central portion of the body of the upper tiles is particularly advantageous in providing flexibility to receive the securing means extending upwardly from the lower tiles. The securing means which extend from the ends of the tiles are not required to be as flexible as those from the central region. The securing means from the ends form arrow-like elements when the tiles are placed side by side, the guide bars on these being even with the legs at one end. The guide bars 18 are oriented to act as "funnels" to direct the corresponding guide bars into the gaps between the securing means.

Figure 4:
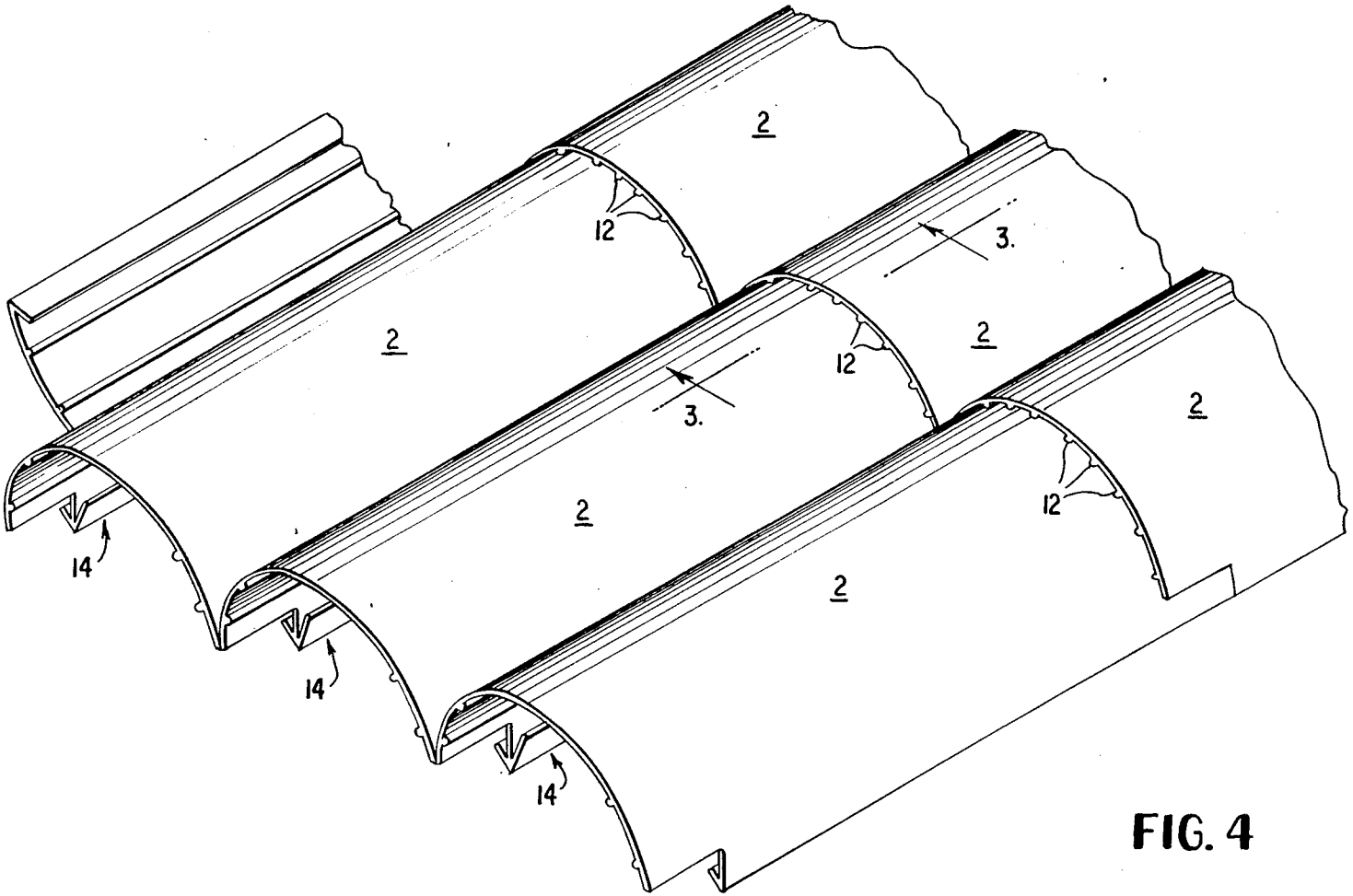
FIG. 4 is a perspective of a fourth embodiment of the invention showing the overlap feature.

The securing means 14 terminate inwardly of the ends of the tiles to allow an overlap, as will be more clear from consideration of FIG. 4. Alternatively, the end parts of legs 16 are notched, as illustrated at 17, to receive an end portion of an overlapped tile. In this case, the portion of the securing means below the notches engages the securing means from the lower tile as shown in the figures.

Figure 1A:
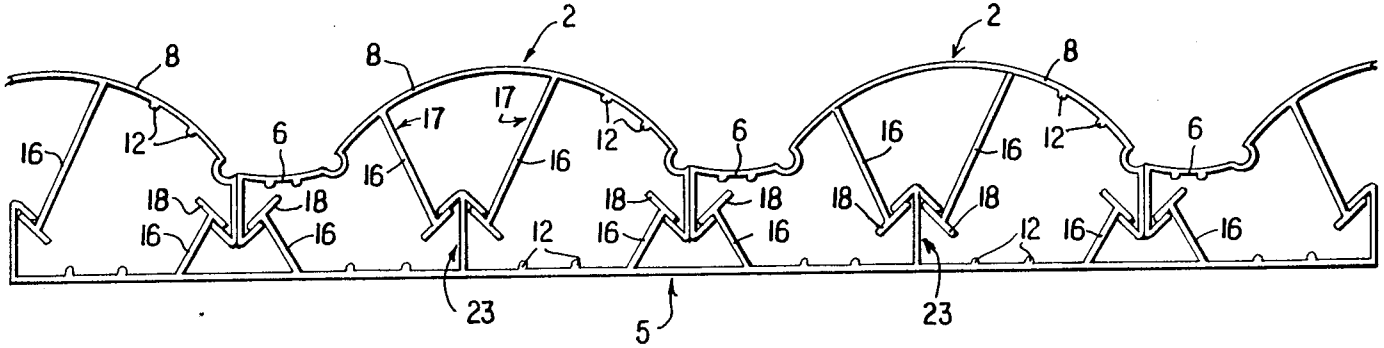
FIG. 1*a* is an end view of an embodiment of the tile shown in FIG. 1 a single bottom section.

FIG. 1*a* shows an arrangement similar to that of FIG. 1, except that the plurality of bottom parts 4 have been replaced with a single part 5, and alternate securing means on part 5 are arrow-like protrusions 23.

Figure 2:
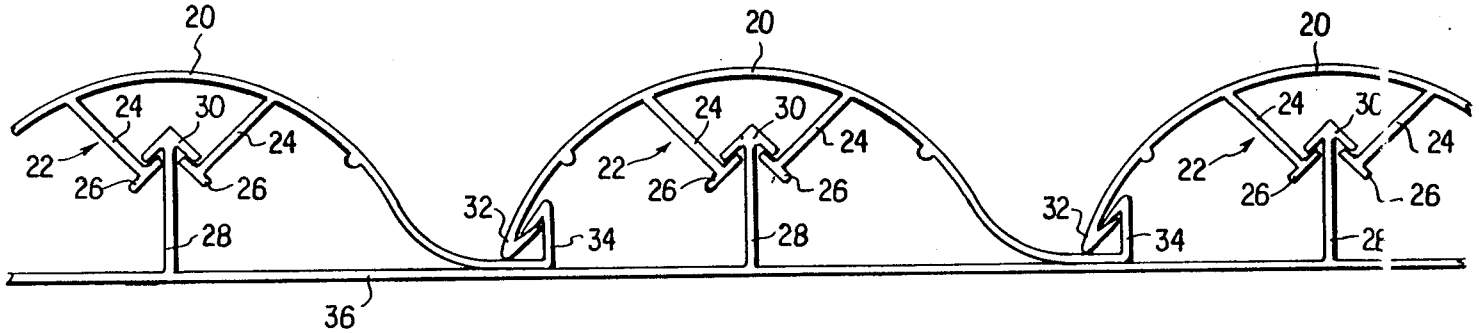
FIG. 2 is an end view of a second embodiment of a tile in accordance with the invention.

FIG. 2 shows a second embodiment of a tile in accordance with the invention. Upper tiles 20 include securing means 22, each of which comprises a flexible leg 24 and a guide bar 26, as described with respect to similar elements of FIG. 1. The securing means 22 form clamps for receiving tips 30 of an arrow-shaped protrusions 28. Opposite ends of upper tiles 20 have hook members 32 and 34 for receiving similar hook members of adjacent tiles.

Bottom tile 36 in FIG. 2 is preferably a single, elongate tile which may be nailed to a wall or roof.

Figure 3:
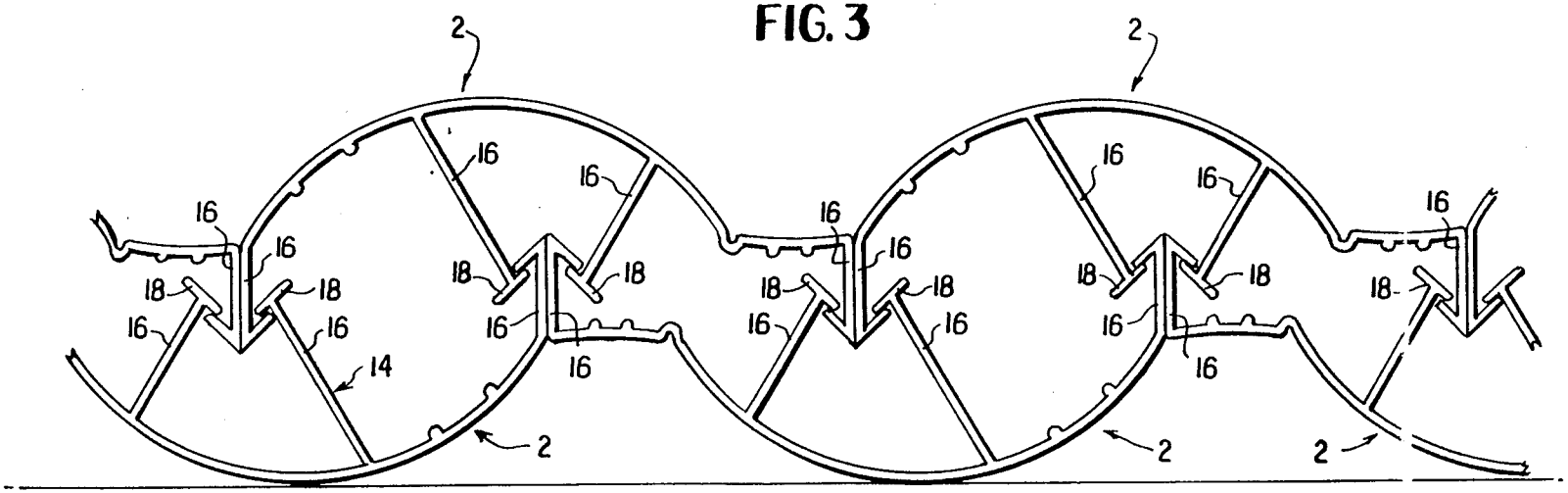
FIG. 3 is an end view of a third embodiment of a tile in accordance with the invention.

FIG. 3 shows a third embodiment of a tile in accordance with the invention. This embodiment is quite similar to that shown in FIG. 1, and identical reference numerals have been used for same parts. The upper tiles of the embodiment of FIG. 5 are identical to the bottom tiles. This would be advantageous if the tiles were being used to form a wall, the simulated clay tile appearance being seen from both sides.

FIG. 4 is a perspective of a fourth embodiment and illustrates the shadow effect of the overlap caused by the ridges 12.

The LAP portions may have lengths of approximately an inch whereby water leaking into the space between the tiles is channeled away from the intersections between the adjacent bottom tiles. Thus, the arrangement is water tight. The width and length of the tiles may vary to provide any convenient size to facilitate installation. The height of the tile will depend on the design of the body part and may be several inches.

It will be appreciated that a tile has been described which is useful for the construction of a roof, wall, or the like, and which is easily molded and assembled. Modifications within the scope of the appended claims will be apparent to those of skill in the art.

I claim:

1. An architectural tile comprising a body, first securing means extending in a longitudinal direction along opposite sides of said body for being received in a clamping means of a facing file for securing adjacent tiles together, clamping means on said body intermediate said first securing means, wherein said first securing means and said clamping means comprise means for receiving an end of an adjacent, overlapped body in said longitudinal direction allowing said body to overlap said adjacent, overlapped body, and ridge means extending from the bottom surface of said body for engaging an upper surface of said adjacent overlapped body for spacing said body from said overlapped body for creating a shadow line.

2. An architectural tile according to claim 1 wherein said clamping means and first securing means terminate at locations spaced from the end of said body to permit said end of said body to overlap said overlapped body.

3. An architectural tile according to claim 2 wherein each of said first securing means at opposite sides comprises a leg extending from said bottom surface and terminating at guide bar means for engaging said clamping means.

4. An architectural tile according to claim 3 wherein said guide bar means extends transversely to said leg.

5. An architectural tile according to claim 1 further comprising said facing tile, wherein said clamping means of said facing tile extends longitudinally along said facing tile.

6. An architectural tile comprising a body, first securing elements extending longitudinally along opposite sides of said body and two flexible, second securing elements intermediate said sides and forming a clamp, wherein said second securing elements comprise two legs extending from a bottom surface of said body toward each other and a guide bar at an end of each of said legs for directing corresponding guide bars from a facing tile between said two legs, said guide bars being transverse to said legs.

7. An architectural tile according to claim 6 wherein said guide bar of said second securing elements extend to opposite sides of said leg.

8. An architectural tile according to claim 6 wherein said body is cylindrical.

9. An architectural tile according to claim 6 wherein said body comprises a cylindrical portion and a flat portion.

10. An architectural tile according to claim 9 wherein securing elements forming said clamp means extend from said cylindrical portion.

11. An architectural tile according to claim 6 wherein said first securing elements and said second securing elements are configured to allow an end of said body to overlap an end of an adjacent architectural tile.

12. An architectural tile according to claim 7 wherein said body includes ridge means for providing a space between overlapped portions of adjacent said tiles to create a shadow line.

13. An architectural tile according to claim 11 wherein said first and second securing elements terminate longitudinally before said end of said body.

14. An architectural tile comprising a body, first securing elements extending in a longitudinal direction along opposite sides of said body for engaging a clamp for holding said body and second securing elements extending in said longitudinal direction along said body intermediate said sides and forming a clamp for receiving securing elements from a facing body, wherein said first securing elements and said second securing elements comprise means for receiving an end of an adjacent overlapped body to allow one end of said body to extend over said end of said adjacent body in said longitudinal direction.

15. An architectural tile according to claim 14 wherein said first and second securing elements have notches therein for receiving said end of an adjacent body.

16. An architectural tile according to claim 14 wherein said first and second securing elements terminate longitudinally before said one end.

* * * * *